US006845595B2

(12) United States Patent
Van Loon

(10) Patent No.: US 6,845,595 B2
(45) Date of Patent: Jan. 25, 2005

(54) METHOD FOR CONSTRUCTING A BALANCED STAIR

(75) Inventor: Marc Van Loon, Essen (BE)

(73) Assignee: MVL Internationale Unternehmen Aktiengesellschaft S.A. MVL S.A., Merkholtz (LU)

( * ) Notice: Subject to any disclaimer, the term of this patent is extended or adjusted under 35 U.S.C. 154(b) by 64 days.

(21) Appl. No.: 10/276,314

(22) PCT Filed: May 21, 2001

(86) PCT No.: PCT/BE01/00089

§ 371 (c)(1),
(2), (4) Date: Nov. 25, 2002

(87) PCT Pub. No.: WO01/90508

PCT Pub. Date: Nov. 29, 2001

(65) Prior Publication Data

US 2003/0172616 A1 Sep. 18, 2003

(30) Foreign Application Priority Data

May 23, 2000 (EP) ..... 00870113

(51) Int. Cl.[7] ..... E04B 1/00
(52) U.S. Cl. ..... 52/741.2; 52/182
(58) Field of Search ..... 52/741.2, 182

(56) References Cited

U.S. PATENT DOCUMENTS 4,367,613 A * 1/1983 Strub ..... 52/188
5,347,774 A * 9/1994 Smith ..... 52/182
5,632,124 A * 5/1997 Weingarten et al. ..... 52/187

FOREIGN PATENT DOCUMENTS

| | | |
|---|---|---|
| DE | 30 49 527 A1 | 7/1982 |
| DE | 197 05 611 A1 | 10/1998 |
| FR | 2 299 471 | 3/1975 |

* cited by examiner

*Primary Examiner*—Carl D. Friedman
*Assistant Examiner*—Steve Varner
(74) *Attorney, Agent, or Firm*—Jacobson Holman

(57) ABSTRACT

For designing a balanced stair comprising steps with treads (1–15) showing front edges (26), a line of travel (22) is determined on the stair and a reference line is determined onto each step in a predetermined position with respect to the front edge (26) thereof. In contrast to the prior art methods wherein the reference lines, more particularly the front edges (26) or the risers (25) of the steps, are divided along the line of travel (22) on constant mutual distances measured on the line of travel itself, the substantially constant mutual distances (d) between the reference lines is determined according to the invention near the line of travel (22) along a measuring line (27) which is determined for each pair of adjoining reference lines so as to form a substantially constant angle (α) with at least one of the adjoining reference lines thereof. In this way, a stair which is easier to walk on and which automatically shows a more regular nosing line at the outer string (21) is obtained FIG. 8.

11 Claims, 17 Drawing Sheets

PRIOR ART
1
2
3
21'

METHOD FOR CONSTRUCTING A BALANCED STAIR

This is a nationalization of PCT/BE01/00089, filed May 21, 2001 and published in English.

The present invention relates to a method for constructing a balanced stair comprising steps with treads showing front edges, which method comprises the step of designing the stair and the step of materially constructing the stair so designed, the designing step comprising the step of determining a line of travel on the stair, the step of determining a reference line onto each step in a predetermined position with respect to the front edge thereof, and the step of dividing said reference lines along said line of travel so that the reference lines of each pair of two adjoining reference lines are situated on a substantially constant mutual distance near said line of travel, at least a number of said steps being balanced so that the front edges thereof define an angle different from a right angle with said line of travel.

Such a method is for example disclosed in the treatise on "Stairbuilding and handrailing" by W. and A. Mowat, published in 1989 by Stobart Davies Ltd., London, and in DE-A-1 97 05 611. Both publications disclose techniques for balancing the steps of a turning stair comprising fliers, i.e. steps of uniform or parallel width, and winders, i.e. steps that are narrower at one end than the other. The object of these balancing techniques is to make the inner end of the winders broader so that they are more convenient and saver to walk on and so that the pitch thereof at the inner string of the stair is less steeper whereby a sudden and ungraceful bend, where the two different pitched parts of winders and fliers join in with each other, is avoided. When balancing the steps of a stair, the steps in the turning and one or more steps before or after the turning are swung about the point of intersection of a reference line, which is either their riser line or their front edge, with the line of travel so that this reference line is no longer perpendicular to the line of travel. The larger the number of balanced or dancing steps before or after the turning and the more equal these steps are graduated on the inner string, the greater the difference between the angle formed by the reference line of the steps with the line of travel and a right angle, especially for the step just before or after the turning.

In the known balancing techniques, the line of travel is first divided in equal lengths, corresponding to the width of tread measured on the line of travel. In DE-A-197 05 611, the total length of the line of travel, including the length of the straight portions and the length of the circular portion is for example simply divided by the number of steps to achieve a constant width of tread, or distance between the reference lines, at the line of travel. Subsequently, the points of intersection of the reference lines on the steps with the inner string of the stair are determined. In other words, the widths of the steps are graduated at the well, i.e. at the inner side of the stair. The reference lines, in particular the riser lines, are then drawn between the points determined on the inner string and the points determined on equal distances on the line of travel.

A drawback of the stairs designed in this way, is that notwithstanding the different judicious balancing techniques for graduating the widths of the steps at the inner side of the stair, they are not very easy to walk on, especially when more steps are balanced to a great extend before or after the turning. Another drawback is that, in case of a turning stair, just before or after the turning, a somewhat irregular nosing line is often obtained at the outer side of the stair, especially in case of a small number of relatively strongly balanced steps just before or after a turning. This means that either an irregular wall string has to be used or that there is otherwise no constant distance between the noses of the steps and the upper edge of the wall string. On the other hand, the steps could possibly be swung a little bit manually in that irregular part to achieve a nosing line parallel to the upper edge of the wall string. Such a correction makes the stair however still not easy to walk on.

An object of the present invention is therefore to provide a new method for designing a stair which allows to obviate the above drawbacks of the existing design methods.

To this end, the method according to the invention is characterised in that in said dividing step, said substantially constant mutual distance is determined near said line of travel along a measuring line which is determined for each pair of adjoining reference lines so as to form a substantially constant angle with at least one of the adjoining reference lines thereof.

It has been found according to the invention that by measuring the distances between the adjoining reference lines, i.e. in particular the width of the treads, near the line of travel along measuring lines which form, in contrast to the line of travel itself, a constant angle with at least one of the adjoining reference lines, the stair so designed is easier to walk on and an irregular curving of the nosing line on the outer side of the stair, just before or after a turning, can be avoided. Compared to the prior art methods for designing a stair, the balanced steps just before or after a turning will generally have a larger width of tread whilst the other steps will have a correspondingly smaller width of tread.

In a particular embodiment of the method according to the invention, the stair has two opposite ends, and, starting at least from the reference line on the step at a first one of said opposite ends, the adjacent reference line situated closer to a second one of said opposite ends is each time positioned on said substantially constant mutual distance measured near said line of travel along said measuring line to form each time one of said pairs of adjoining reference lines, which measuring line is determined for this latter pair of adjoining reference lines so as to form said substantially constant angle with the reference line which is the closest to said first end and/or with the reference line which is the closest to said second end.

In a preferred embodiment of the method according to the invention, said substantially constant angle is an angle of between 80 and 100°, preferably an angle of between 85 and 95° and most preferably an angle of about 90°.

In a further preferred embodiment of the method according to the invention, said measuring line has a length equal to said substantially constant mutual distance and is positioned in such a manner with respect to the line of travel that a predetermined point on the measuring line, preferably the middle point thereof, is situated on said line of travel.

Other particularities and advantages of the invention will become apparent from the following description of some particular embodiments of the method of the present invention. The reference numerals used in this description relate to the annexed drawings wherein.

Figure 7:
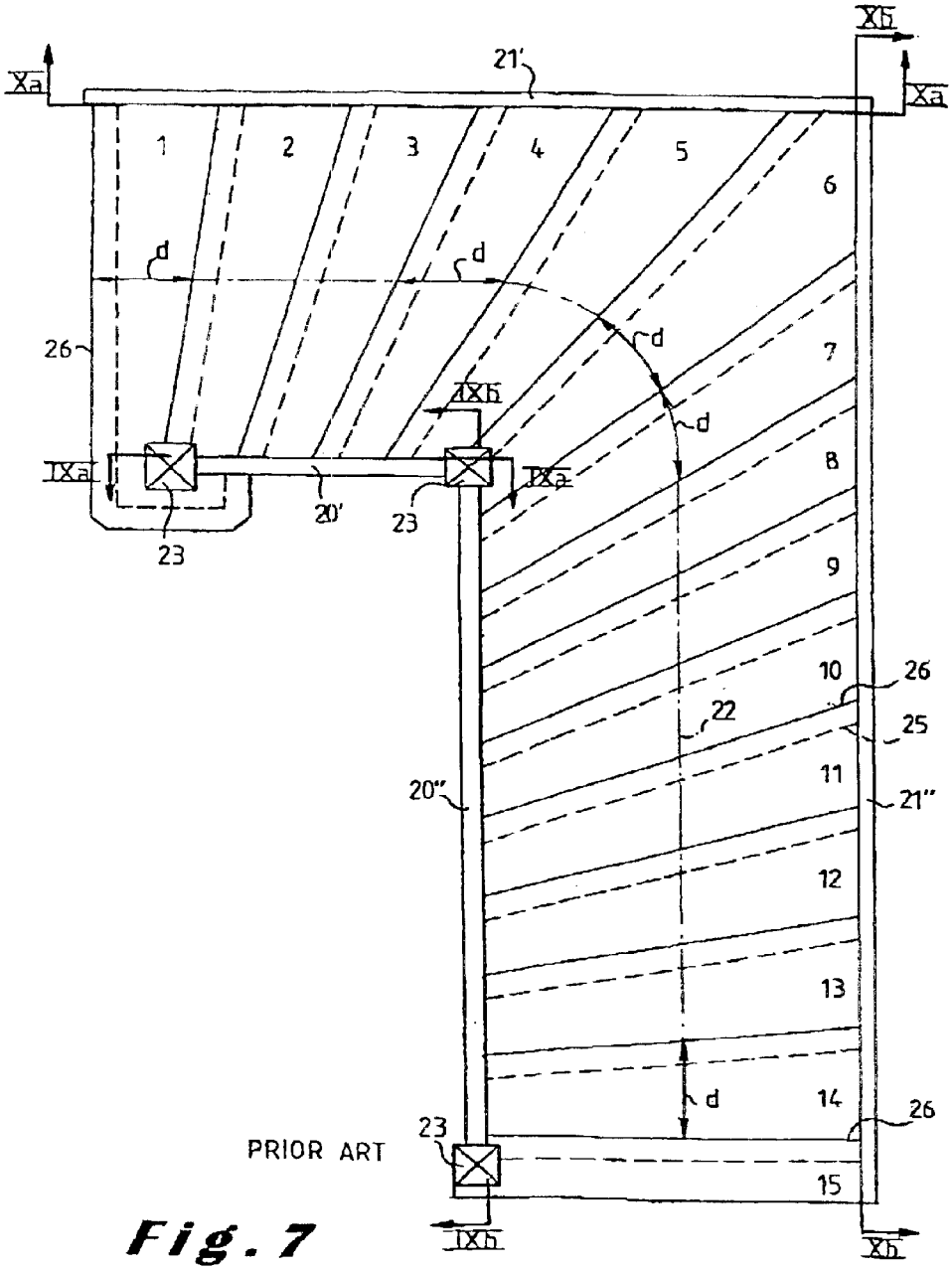
FIG. 7 is a schematic top plan view on a quarter-turn prior art stair which is entirely balanced to achieve equal widths along the inner strings.
Figure 8:
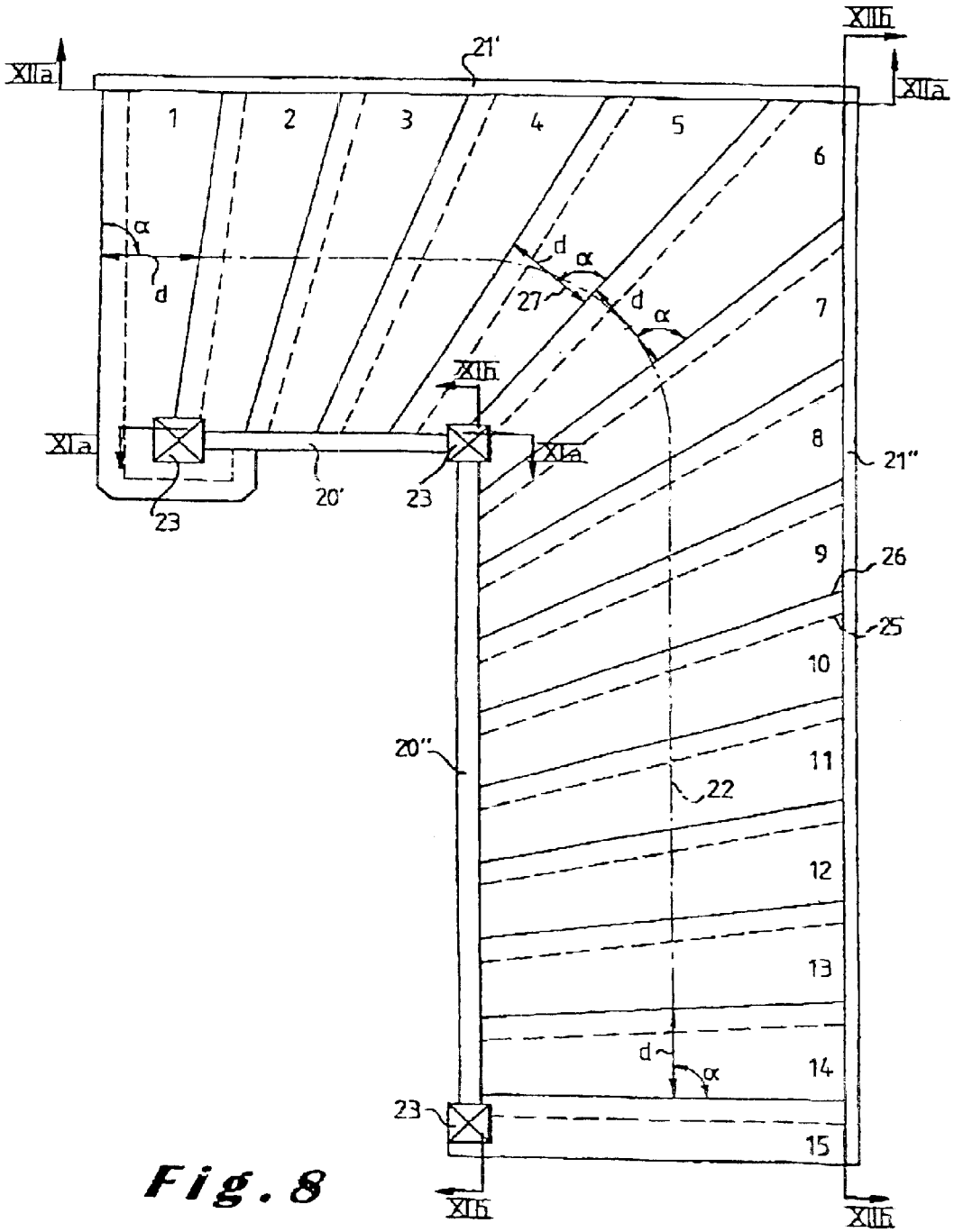
FIG. 8 is a schematic top plan view on the same stair as shown in FIG. 7 but now designed in accordance with the method of the present invention.
Figure 13:
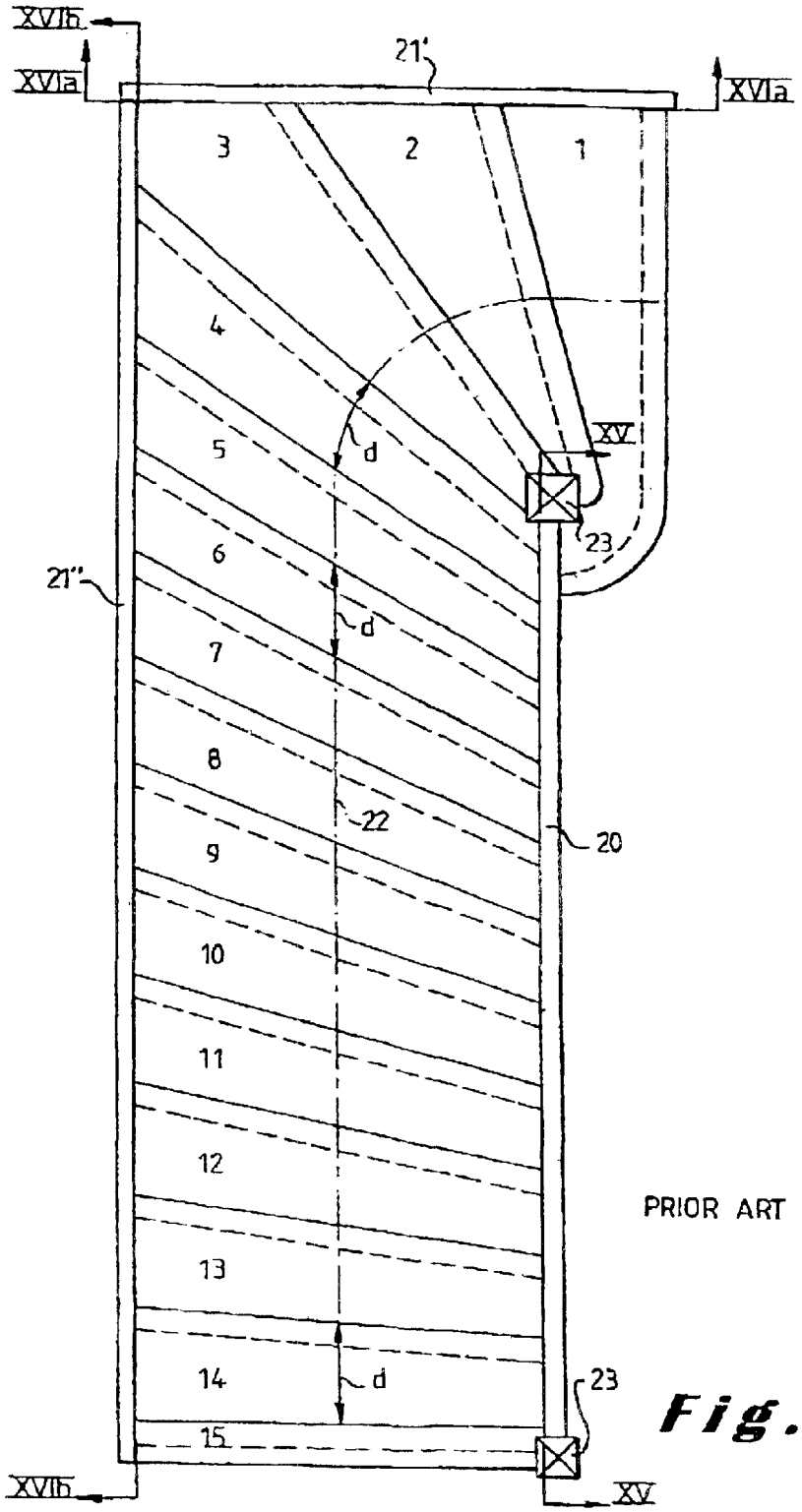
Figure 14:
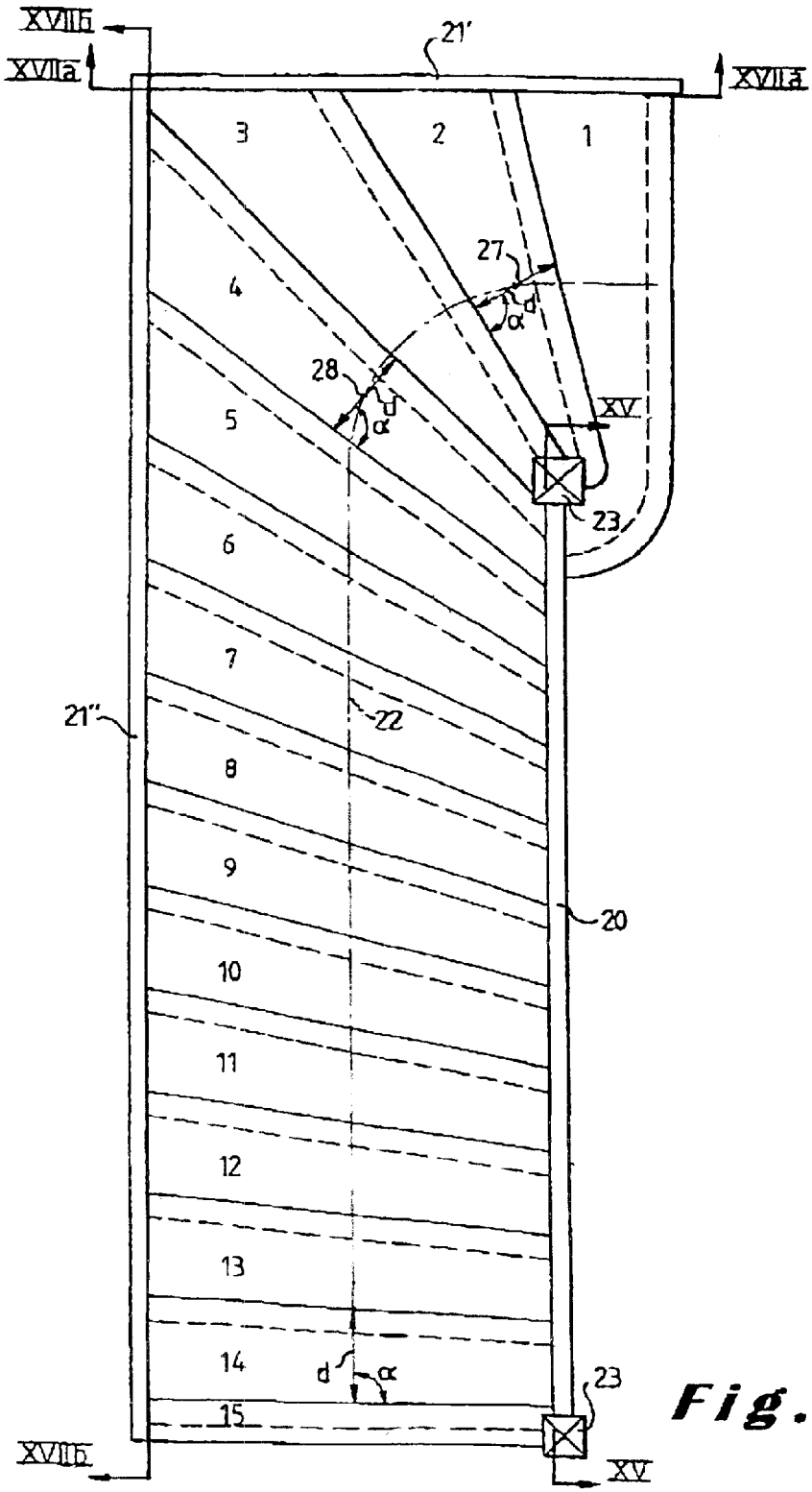
Figure 15:
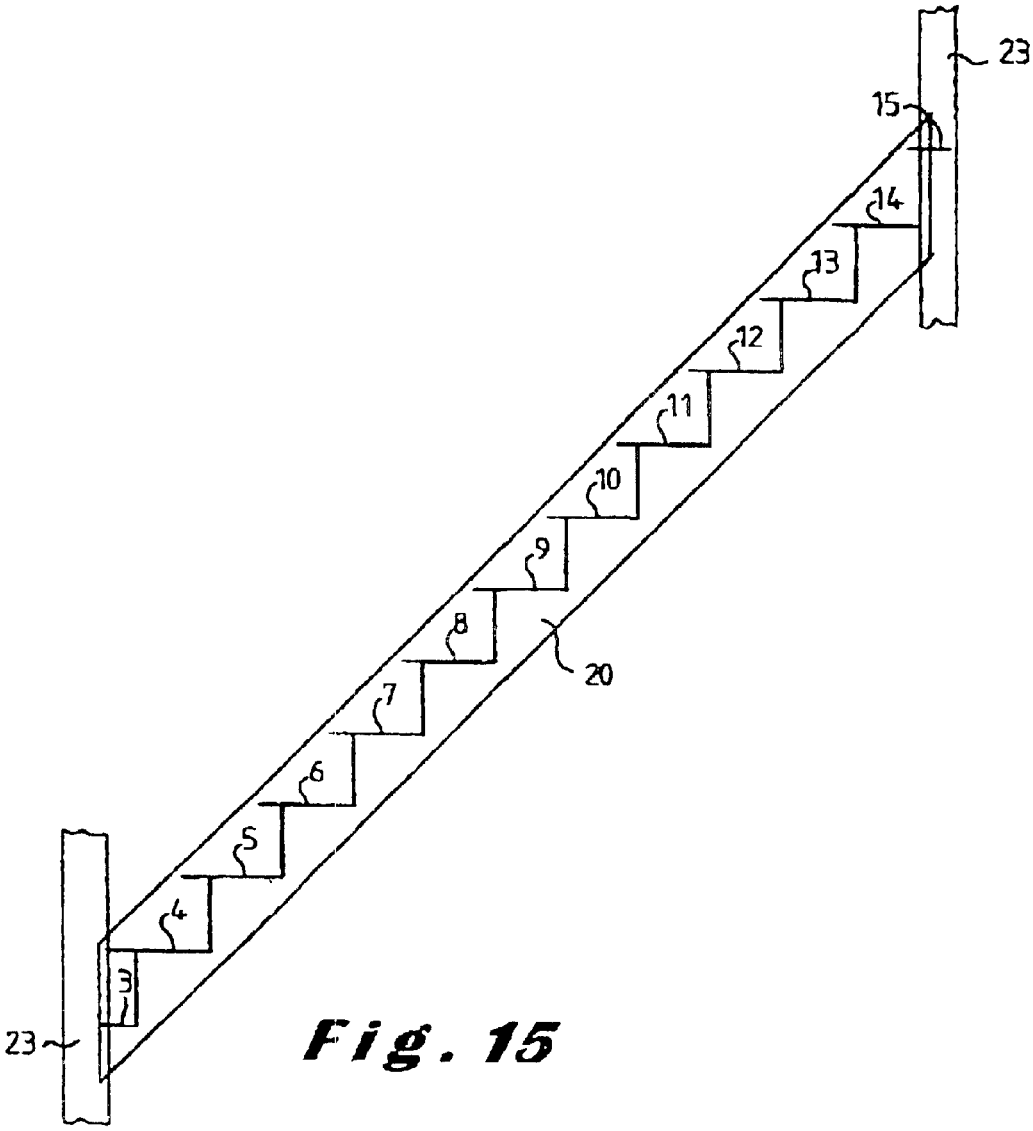
Figures 16A, 16B:
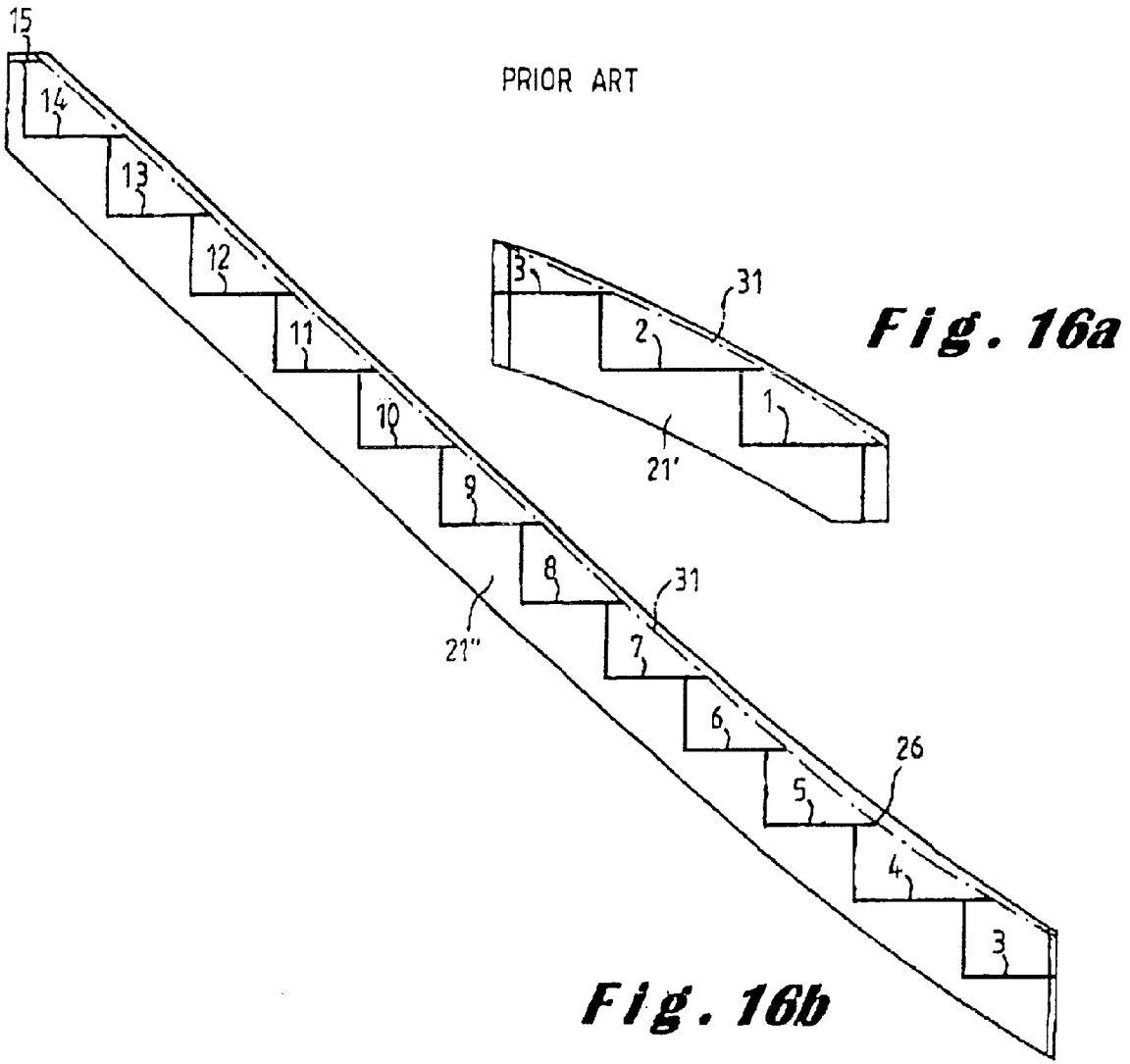
Figures 17A, 17B:
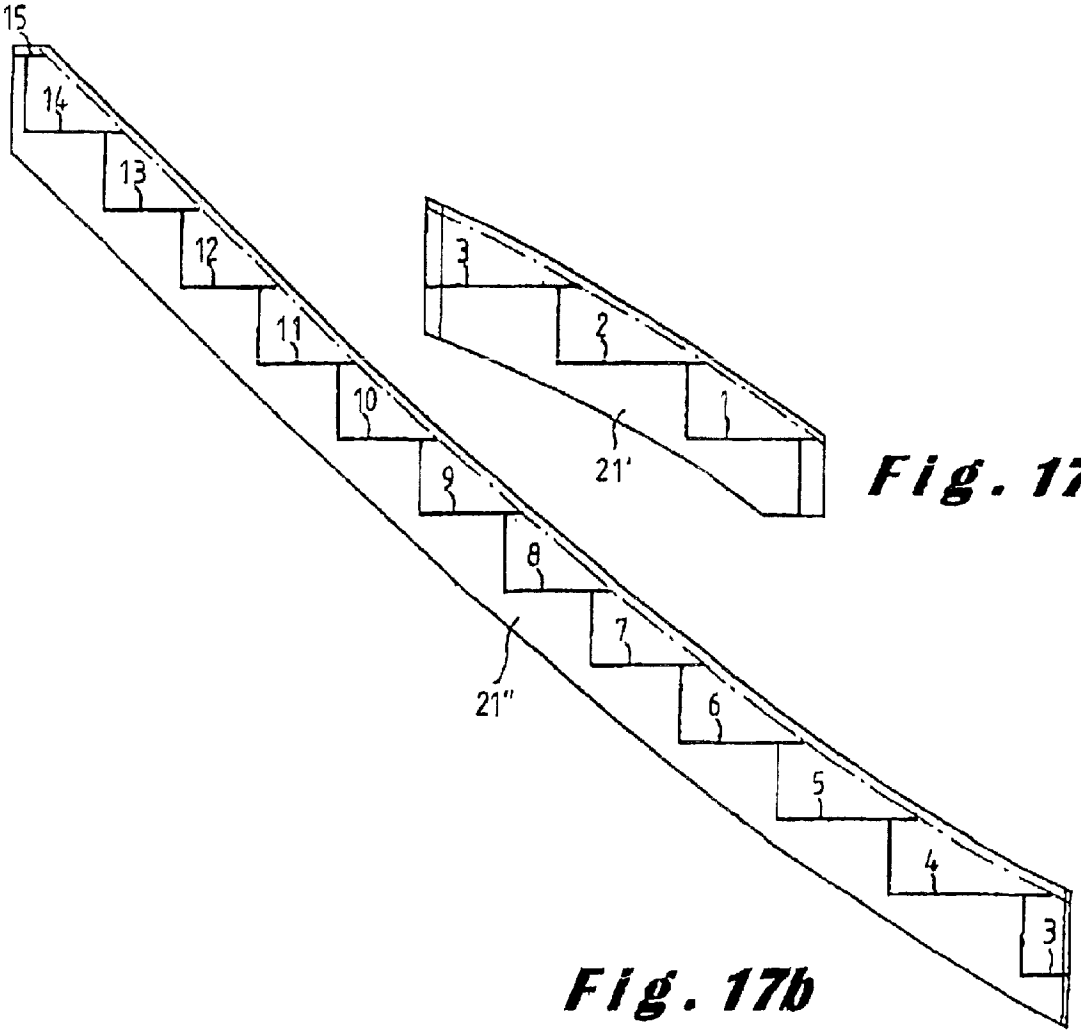
Figure 18:
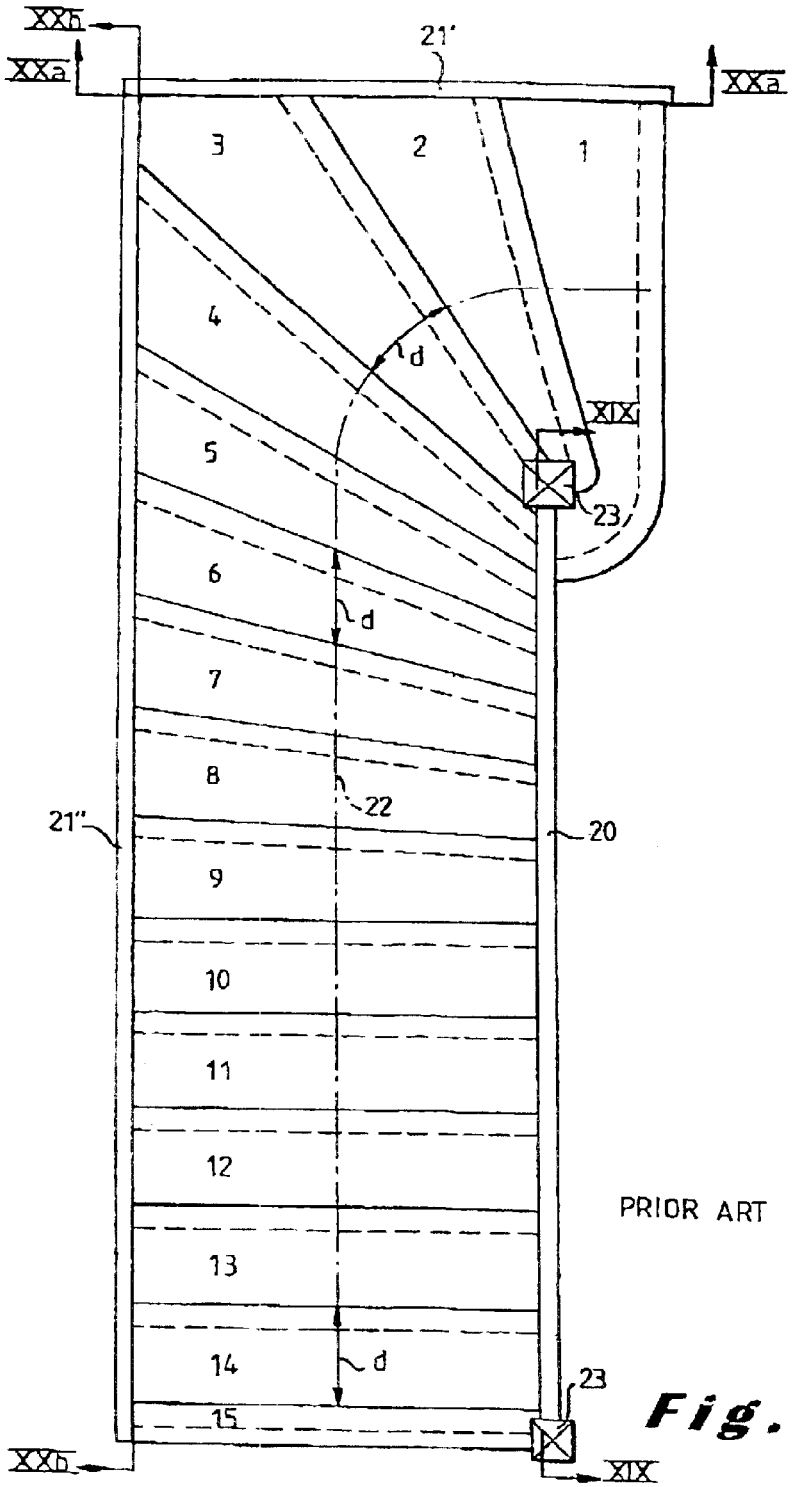
PRIOR ART Fig. 18
Figure 19:
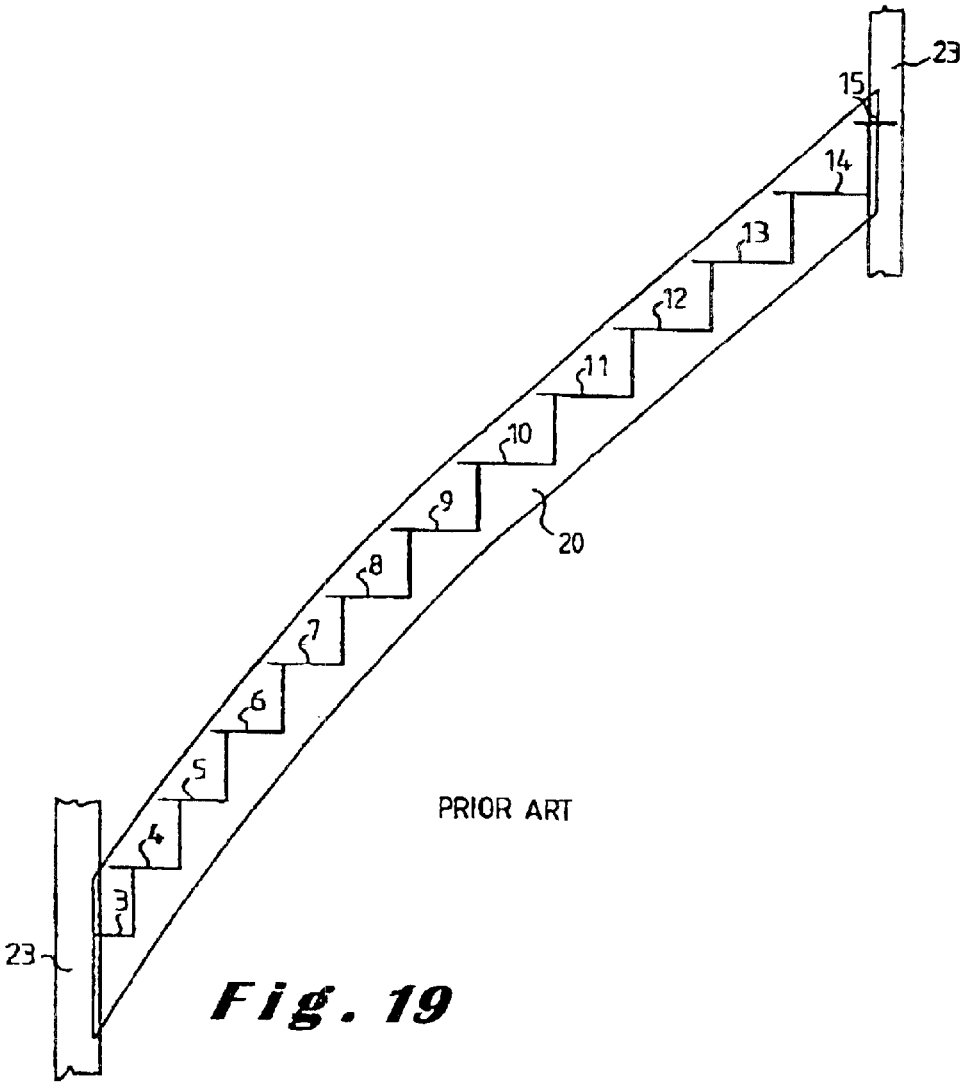
Figures 20A, 20B:
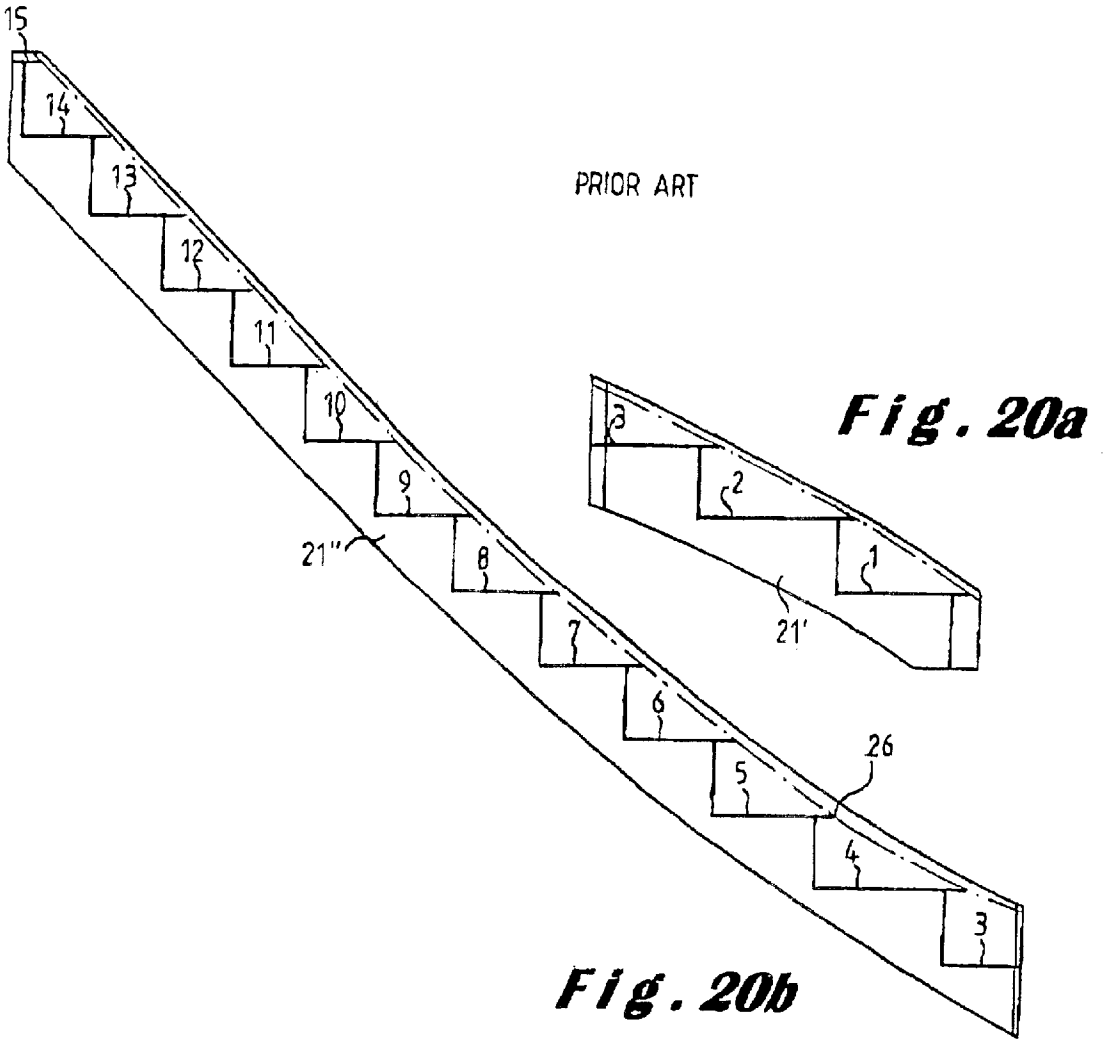

FIGS. 9*a*, 9*b* and 10*a* and 10*b* are schematic side elevational views, on a smaller scale, respectively according to lines IXa—IXa, IXb—IXb, Xa—Xa and Xb—Xb in FIG. 7;

FIGS. 11*a*, 11*b* and 12*a* and 12*b* are schematic side elevational views, again on a smaller scale, respectively according to lines XIa—XIa, XIb—XIb, XIIa—XIIa and XIIb—XIIb in FIG. 8;

FIG. 13 is a schematic top plan view on a further quarter-turn prior art stair which is entirely balanced to achieve equal widths along the inner string;

FIG. 14 is a is a schematic top plan view on the same stair as shown in FIG. 13 but now designed in accordance with the method of the present invention;

FIG. 15 is, on a smaller scale, a schematic side elevational view according to lines XV—XV in FIGS. 13 and 14;

FIGS. 16*a* and 16*b* are, again on a smaller scale, schematic side elevational views according to lines XVIa—XVIa and XVIb—XVIb in FIG. 13;

FIGS. 17*a* and 17*b* are, also on a smaller scale, schematic side elevational views according to lines XVIIa—XVIIa and XVIIb—XVIIb in FIG. 14;

FIG. 18 is a schematic top plan view on a still further quarter-turn prior art stair, six steps of which are balanced after the turning;

FIG. 19 is, on a smaller scale, a schematic side elevational view according to lines XIX—XIX in FIG. 18; and FIGS. 20*a* and 20*b* are, also on a smaller scale, schematic side elevational views according to lines XXa—XXa and XXb—XXb in FIG. 18.

In the different figures, the same reference numerals designate the same or analogous elements.

In the method according to the invention for constructing a balanced stair, this stair is first designed and subsequently materially constructed. Designing of the stair can either be done manually or automatically by means of a computer program which implements the method steps according to the present invention.

For designing the stair, the required dimensions are measured of the place where the stair has to be installed and the inner 20 and outer strings 21 are drafted in the usual way. The outer string 21 will usually be fixed to the wall and is consequently also often called the wall string. It should be noted however that the presence of an inner and/or outer string is not an essential feature of the present invention, and that the stair can also be constructed without an inner or outer string. For designing the stair, the required number of steps 1 to n is determined in the usual way as well as the line of travel 22. This is the line which a user normally will take when ascending or descending the stair. It is usually drawn at a constant distance of between 35 and 45 cm from the inner string 20 or, in case there is no inner string, from the inner side of the stair. In case of a newelled turning stair, the line of travel is composed of at least one straight portion followed by a circular portion having as middle point the centre of the newel 23.

According to the prevailing standards, the steps, in particular the actual treads 24 thereof, must have a constant going or width of tread. This value is defined as the horizontal distance between the front edges or nosings 26 of two consecutive treads 24 or, if the steps are provided with vertical risers 25 connecting the horizontal treads 24 (which is however not an essential feature of the invention since he risers can easily be omitted), the horizontal distance between the front faces of two consecutive risers 25. In the prior art methods, the length of the line of travel 22 is determined and divided by n−1 (i.e. the number of steps minus one) to obtain a particular mutual distance between the risers 25 or front edges 26, which distance is measured on the line of travel 22 itself.

In case of an unbalanced stair, the risers 25 or front edges 26 are positioned at right angles to the line of travel 22. In balanced stairs, a number of steps are swung around the fixed points of intersection with the line of travel 22 and, in an entirely balanced stair, all the steps are swung around those fixed points. As explained hereabove, different balancing techniques are known which can all be applied in the method according to the present invention. These techniques are based on different graduations of the width of the steps at the inner string 20. A few balancing methods are described on pages 67 to 72 of the treatise on "Stairbuilding and handrailing" by W. and A. Mowat, which is incorporated herein by way of reference. Also the other parts of this treatise, which disclose how to design different types of stairs, is included herein by way of reference. Since the different balancing techniques are well known by a person skilled in the art, they will not be described herein in detail. Amongst the known balancing techniques, mention can be made of the trap method (with a linear decrease of the width of tread at the inner string towards the newel or the centre of the turning), the harmonic balancing, the balancing in the infinity and, for straight stairs, the warped stair which is a straight stair, the steps of which are swung in such a manner that their front edges are not perpendicular to the line of travel. These techniques are described in "Trappen" by H. Van Daele and V. Seys edited by De Sikkel, which is also incorporated herein by way of reference. A further balancing technique consists in dividing the inner string into equal portions. In this way, a straight inner string, and consequently a straight hand railing is obtained, which results in an economical stair and which is therefore preferred according to the invention. Once the line of travel 22 has been divided into equal parts and the points of intersection of the risers 25 or the front edges 26 of the steps with the inner string 20 have been fixed with one of the balancing techniques, the risers 25 or front edges 26 can simply be positioned or drawn.

The method according to the present invention differs from the above described prior art methods in that the line of travel 22 is not divided in equal parts measured on this line 22 itself. Instead, the mutual distance between the successive risers 25 or front edges 26 is determined along a measuring line 27 which is determined for each pair of adjoining risers 25 or front edges 26 so as to form a substantially constant angle with at least one of the adjoining risers 25 or front edges 26. Since for a balanced stair, the line of travel 22 does not form a constant angle with the risers 25 or front edges 26 of each of the steps, the steps designed by the method according to the present invention have another shape and orientation than the steps designed by the prior art methods.

Instead of taking the riser 25 or front edge 26 of a step as reference line for designing the stair, another reference line can be determined onto each step in a predetermined position with respect to the front edge 26 thereof. Once the reference lines have been positioned on said substantially constant mutual distances in accordance with the method according to the invention, the risers 25 and front edges 26 can be drawn in said predetermined position with respect to the reference lines. These reference lines are preferably parallel to the front edge 26 and coincides most preferably with this front edge 26. Consequently, in the further description the front edges 26 of the steps will be taken as reference lines. This offers the advantage that when dividing the front edges 26 on constant mutual distances at the inner string 20, an entirely straight inner string 20 and handrailing can be used, which is very economical. Such an entirely straight string 20 would for example not be obtained when dividing the risers 25 on equal distances at the inner string 20 in view of the fact that at least a number of the steps are balanced so that there is not a constant distance between the front edges 26 and risers 25 of the steps measured in the longitudinal direction of the inner string 20. Of course, when the steps are balanced on the inner string 20 in such a manner that a curved string 20 is obtained, this is of no or less importance.

Figure 1:
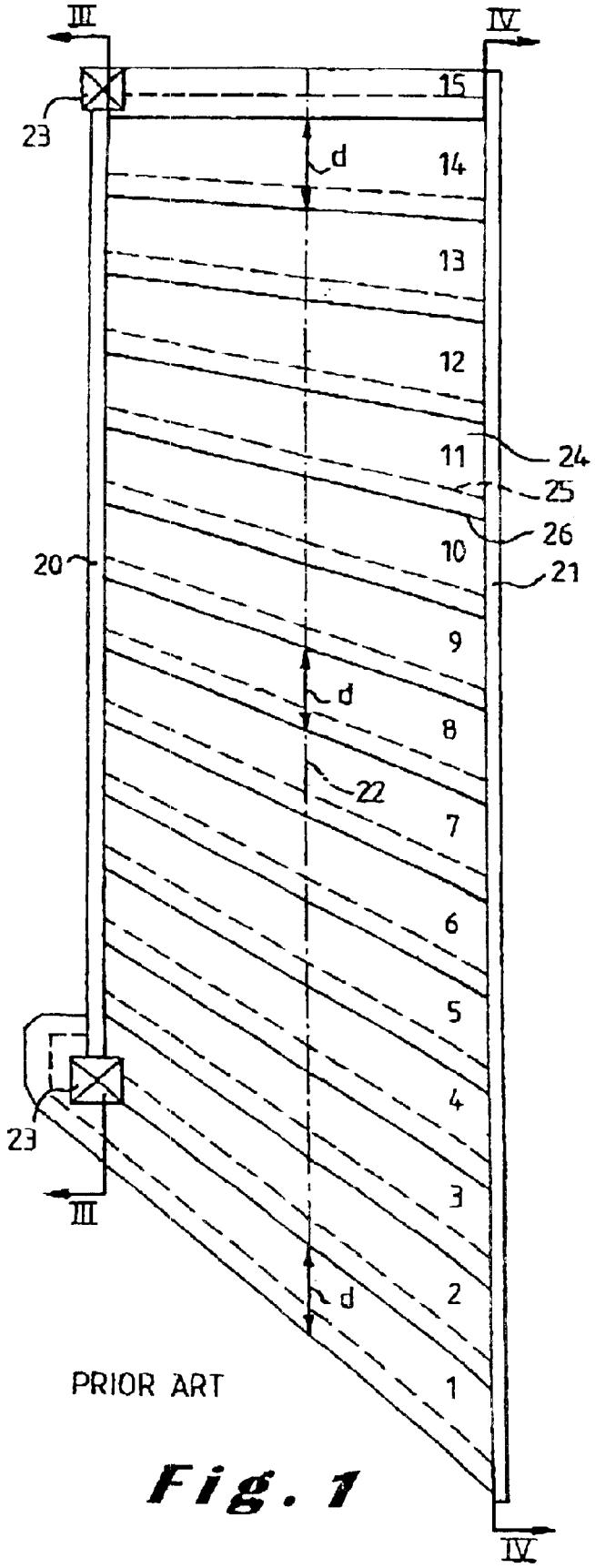
FIG. 1 is a schematic top plan view on a straight prior art stair which is entirely balanced.
Figure 3:
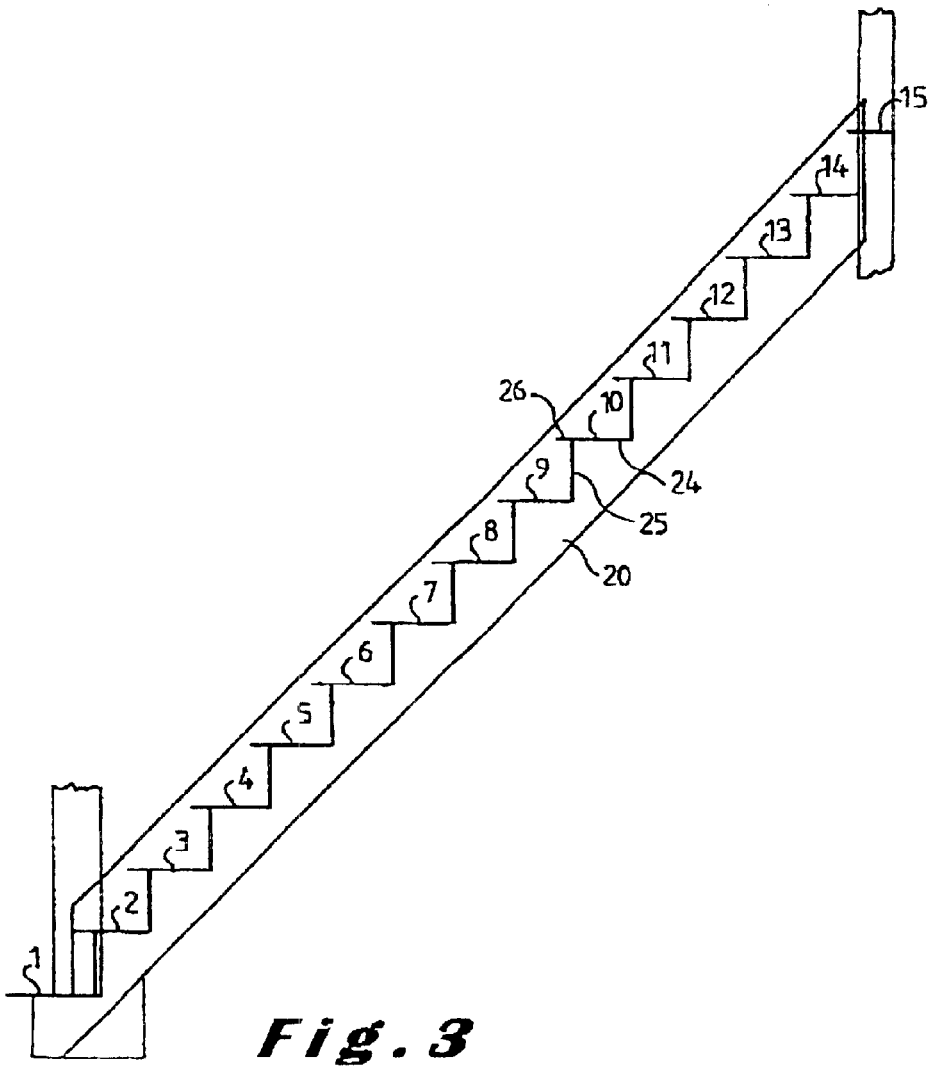
FIG. 3 is, on a smaller scale, a schematic side elevational view according to lines III—III in FIGS. 1 and 2.
Figures 4, 5:
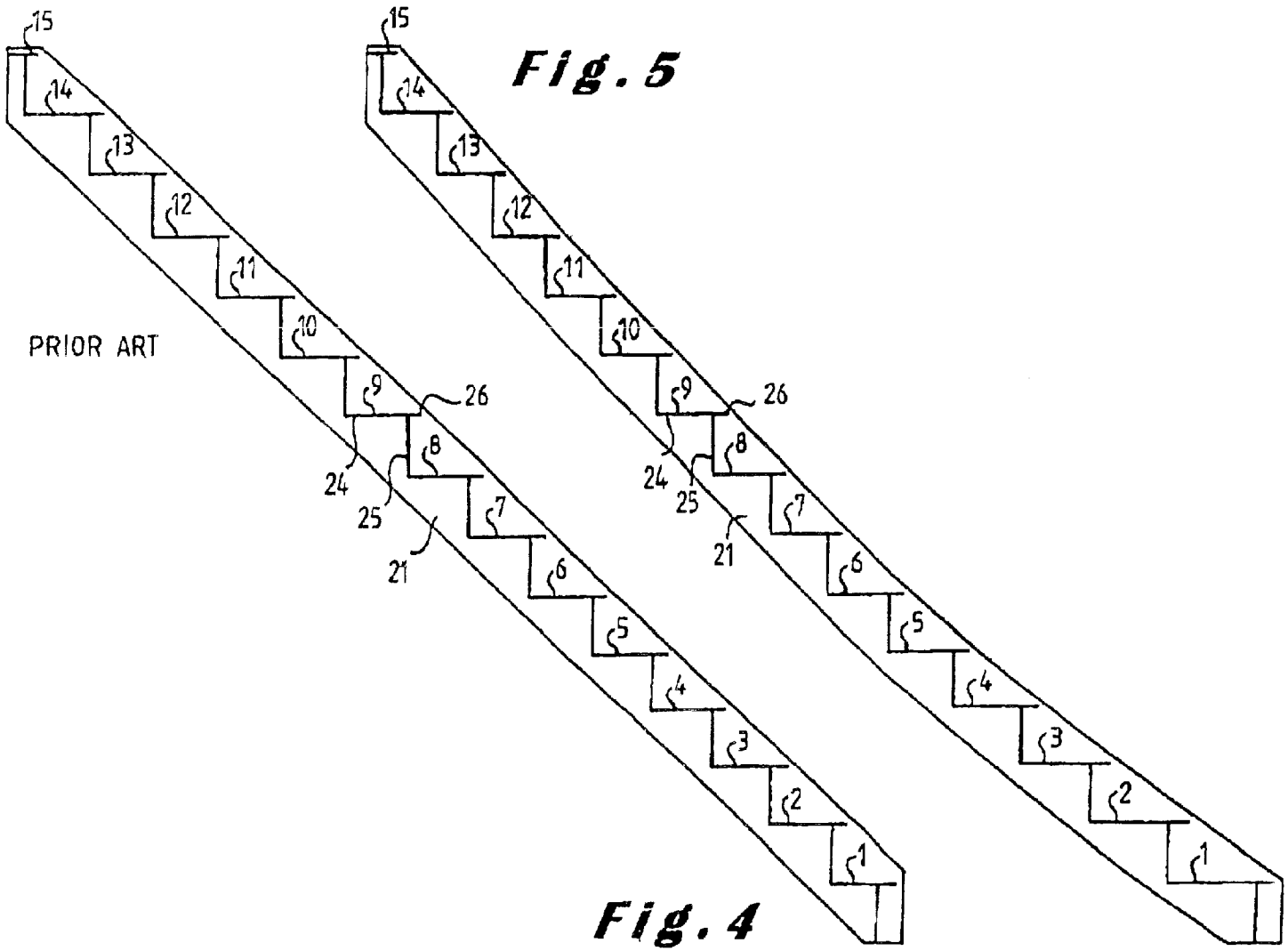
FIG. 4 is, also on a smaller scale, a schematic side elevational view according to lines IV—IV in FIG. 1.
FIG. 5 is, again on a smaller scale, a schematic side elevational view according to lines V—V in FIG. 2.

FIG. 1 shows a top plan view on a straight stair designed according to the prior art method. This stair comprises a straight inner string 20, a straight outer or wall string 21, steps numbered from 1 to 15 represented by their front edges 26 and in dashed lines by their risers 25, and a lower and an upper newel or post 23. At the inner string 20, the front edges 26 are positioned at constant mutual distances so that a straight inner string 20 is obtained as shown in FIG. 3. At the line of travel 22, the constant mutual distances d between the front edges 26 are measured on the line of travel itself so that in this case also a substantially straight outer string 21 is obtained as shown in FIG. 4. A drawback of this stair designed according to the prior art method is that it is not very easy to walk on. Especially when descending this stair, one will not feel very well at ease when arriving nearly at the bottom of the stair since one will have the impression that the steps are relatively narrow at that end notwithstanding the fact that they have a same width of tread measured on the line of travel 22.

Figure 2:
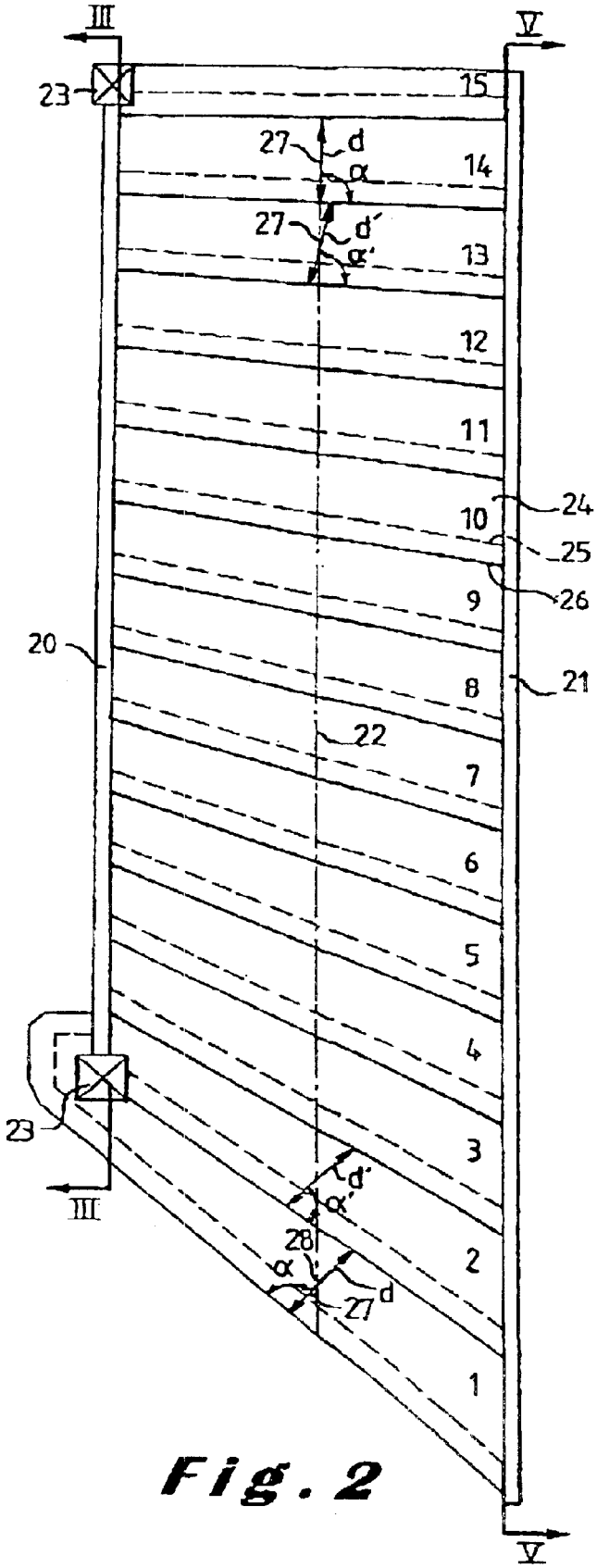
FIG. 2 is a schematic top plan view on the same straight stair as shown in FIG. 1 but now designed in accordance with the method of the present invention.

FIG. 2 shows the same straight stair as illustrated in FIG. 1 but now designed by the method according to the present invention. At the inner string 20, the front edges 26 are again on a same constant mutual distance so that the same inner string 20 as illustrated in FIG. 3 is obtained. However, at the line of travel 22, the constant mutual distances d between the front edges 26 are no longer measured on the line of travel 22 but on measuring lines 27 which form a substantially constant angle $\alpha$ of 90° with one of the front edges 26 of each pair of adjoining front edges, in the embodiment of FIG. 2 each time with the lowermost front edge 26. Although this angle $\alpha$ may be chosen within wide limits, preference is given to an angle $\alpha$ of between 80 and 100°, more particularly to an angle $\alpha$ of between 85 and 95° and most preferably to an angle $\alpha$ of about 90°. An angle $\alpha$ close to or equal to 90° is especially preferred in case of a turning stair which is not balanced to a great extend so that quite wedge shaped winders are present in the turning. The angle $\alpha$ is on the other hand less important in case of strongly balanced stairs wherein the angle defined by two successive front edges is rather constant or wherein there are no pronounced winders.

For designing the stair illustrated in FIG. 2, the front edges 26 of the uppermost step 15 and of the lowermost step 1 are first drawn in the desired position. Subsequently, the points of intersection of the front edges 26 with the inner string 20 are fixed on mutually constant distances. Then, starting from the front edge 26 of step 15 at the uppermost end of the stair, the front edge 26 of step 14 is positioned on said constant distance d measured along the measuring line 27 which forms a right angle $\alpha$ with the front edge 26 of step 14. The measuring line 27 has more particularly a length equal to distance d and is positioned in such a manner that the middle 28 of this measuring line 27 is situated on the line of travel 22. Instead of the middle point 28, another point situated on the measuring line 27 could be taken as point of intersection with the line of travel 22, for example one of the end points or a point therebetween.

Once the front edge 26 of step 14 is positioned in this way, the front edge 26 of step 13 and subsequently of the further steps situated closer to the lowermost end of the stair are positioned in the same way.

Compared to the distance d in FIG. 1, the distance d in FIG. 2 is somewhat smaller in order to achieve the same total stair length. The distance d can therefore not be determined by simply dividing the total length of the line of travel 22 by the number of steps n minus one. In practice, a somewhat smaller distance d can be taken to start with. If it appears that by means of the selected smaller distance d, the front edge 26 of the lowermost step 1 extends beyond the lower end of the stair, i.e. extends beyond the predetermined position for this lowermost front edge, the distance d is reduced somewhat further and the front edges 26 of the different steps are positioned again. If the front edge of the lowermost step still extends beyond its predetermined position, distance d is further reduced. On the other hand, if it does not extend far enough, an intermediate distance d is selected until the front edge 26 of the lowermost step coincides sufficiently accurately with its predetermined position.

The above described method can be performed manually by the person skilled in the art, who, once acquired some experience, will only have to repeat the above process a few times. On the other hand, the method can also be performed by a computer programmed to calculate the different positions of the front edges 26 and to modify distance d until the front edge 26 of the lowermost step is in the predetermined position.

In a first variant embodiment for positioning the front edges 26 on substantially constant mutual distances d, the angle $\alpha$ between the front edges 26 and the measuring lines 27 can also be adapted in such a manner that the front edge 26 of the lowermost step 1 is positioned in the desired predetermined position. Indeed, the smaller angle $\alpha$, the smaller the total length of the stair and vice versa, the more angle $\alpha$ approaches 90°, the larger the total length of the stair when positioning the successive front edges in accordance with the method described hereabove.

In this respect, it should be noted that the angle $\alpha$ should not necessarily be an angle of 90°. In the stair of FIG. 2, it makes no difference when this angle $\alpha$ comprises for example about 80° (=$\alpha'$) or even smaller. Of course, in that case, the distance d' measured in this more oblique way, will be greater than the distance d, but the front edges 26 of the steps will be positioned in substantially the same position (see the measuring lines 27 indicated in broken lines in FIG. 2).

In a further variant embodiment, the measuring lines can also be drawn or positioned at the constant angle $\alpha$ with respect to the front edge 26 of the uppermost step of each pair of steps, i.e. starting from the front edge 26 of step 15. Again, this angle $\alpha$ does not necessarily have to be an angle of 90°.

In still another variant embodiment, the measuring line can be determined for each pair of adjoining front edges to form said substantially constant angle $\alpha$ with for example the uppermost edge 26 and a further substantially constant angle β with for example the lowermost front edge 26. Just like the angle α, the angle β is preferably comprised between 80 and 100°, more preferably between 85 and 95° and may comprises in particular 90°. In this variant embodiment, use can for example be made of a curved measuring line, having a substantially constant length but the curvature radius of which is adapted to form said substantially constant angles α and β with the adjoining front edges 26. On the other hand, use can be made of a broken measuring line showing a kink. The angle under which the measuring line is broken can be adapted for each pair of adjoining front edges to achieve the desired angles α and β.

Figure 6:
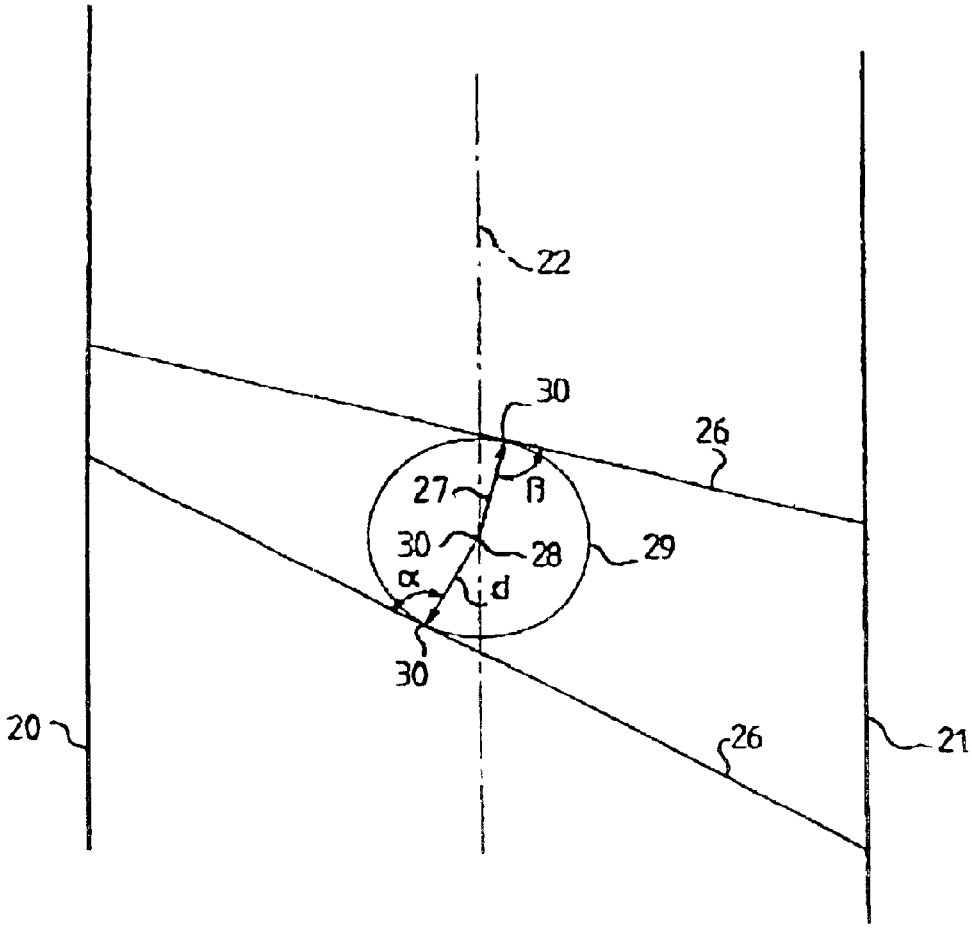
FIG. 6 is a schematic top plan view on one step illustrating an alternative measuring method.

A practical embodiment wherein angles α and β equal about 90° is the embodiment illustrated in FIG. 6. In this embodiment, use is made of a circles 29 having a centre 30 and a substantially constant diameter. This circle 29 is positioned with its centre 30 onto the line of travel 22 in such a manner that the front edge 26 which has already been positioned is tangent to this circle. The next front edge 26 is then positioned so as to be tangent to the circle 29. In this way, the measuring line 27, which has a length equal to the diameter of the circle 29 and which is composed of the two radii going though the two points of contact 30, forms an angle α and β of 90° with the front edges 26. Notwithstanding the fact that in this embodiment with the circles the measuring lines are not actually drawn, the substantially constant mutual distance d is still inherently determined along the measuring lines 27.

FIG. 7 shows a quarter turn stair designed in accordance with the prior art method and FIG. 8 a same quarter turn stair designed in accordance with the method according to the invention. The inner string 20 of this quarter turn stair consists of a lower part 20' and an upper part 20" whilst the outer string 21 also consists of a lower part 21' and an upper part 21". Instead of starting from one end of the stair, the front edges 26 of the lowermost 1 and uppermost step 15 of the stair illustrated in FIG. 8 were now positioned starting from both ends of the stair. Both starting from the upper and the lower end of the stair, the same mutual distance d and the same angle α (equal to 90°) was used.

The front edge 26 of the step 6 right in the middle of the turning was positioned each time starting from both ends. The mutual distance d was modified until this front edge 26 was positioned in substantially the same position both when starting from the upper and from the lower end of the stair. In this way, the method according to the invention is applied in the same way to the parts of the stair before and after the turning, i.e. each time in the direction from the respective end of the stair towards the turn. It will be clear that the same variants or modifications can be applied to this embodiment as described hereinabove for the embodiment of FIG. 2.

When comparing the stairs of FIGS. 7 and 8, it can be seen that in the stair designed according to the prior art method, the step 4 just before the turn and especially the step 8 just after the turn are narrower than the first or the last steps whilst this is not the case in the stair according to the invention illustrated in FIG. 8. As a first result thereof, the stair of FIG. 7 is less easy to walk on than the stair of FIG. 8, especially when descending the stair. A further result is that the stair of FIG. 8 has a more regular nosing line 31 at the outer string 21.

Figure 9B:
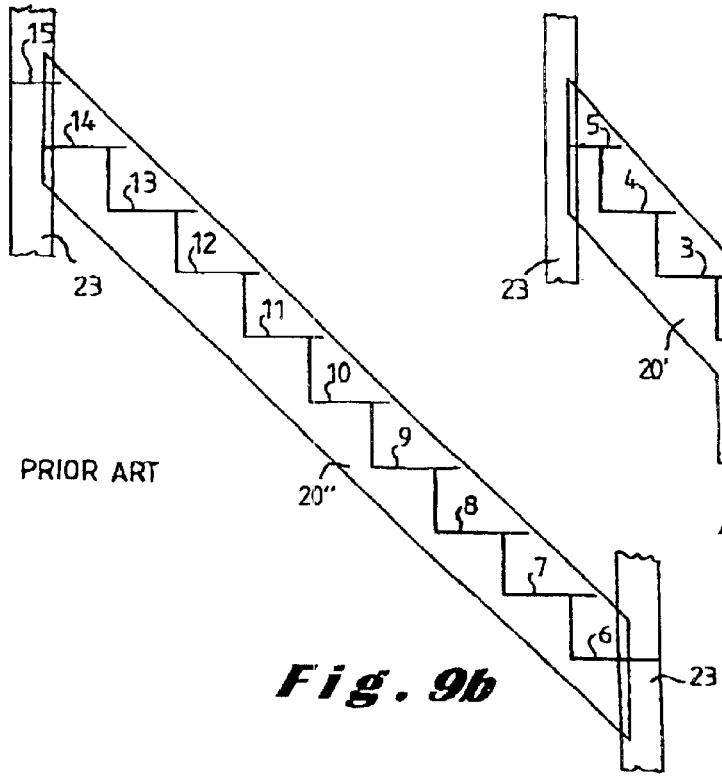
Figure 9A:
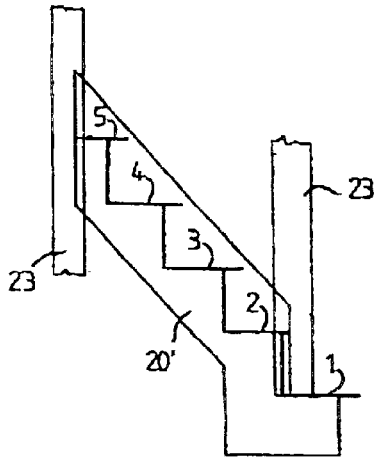

The inner sides of the inner strings 20' and 20" of the prior art stair are illustrated in FIGS. 9*a* and 9*b*. Since the front edges 26 of the steps are divided over the inner string at regular distances, both inner string parts 20' and 20", and thus also the hand railing which has not been illustrated, are entirely straight. This is also the case for the inner strings 20' and 20" of the stair according to the invention illustrated in FIGS. 11*a* and 11*b* respectively.

Figure 10B:
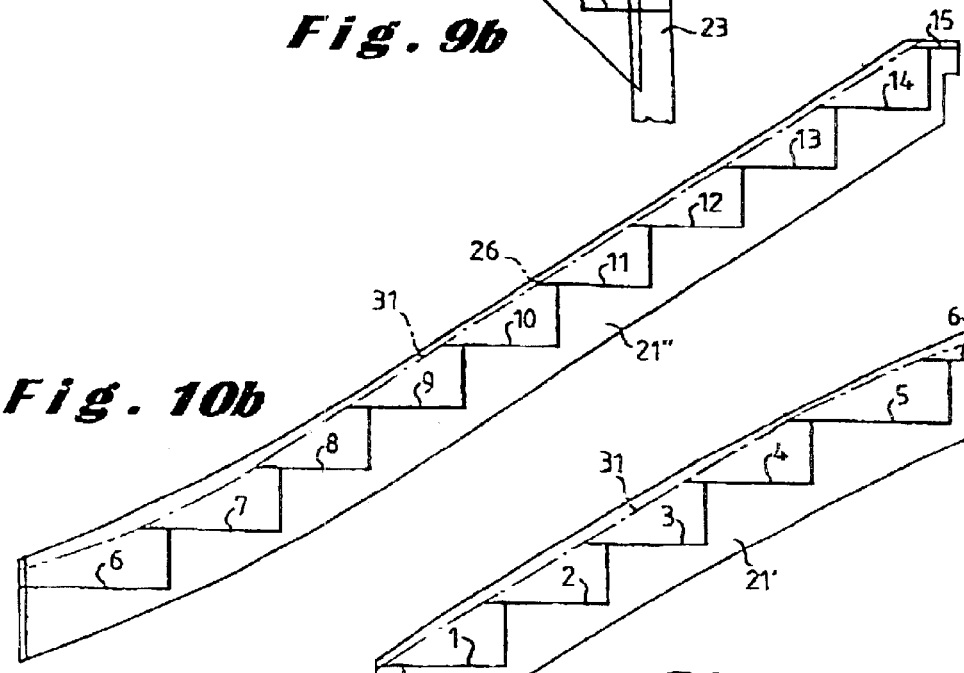
Figure 10A:
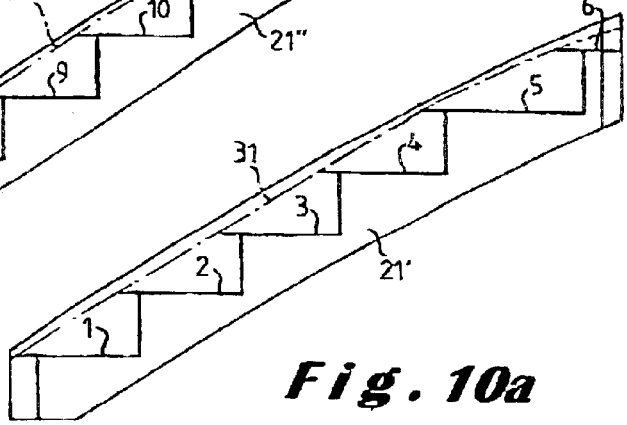
Fig. 10a PRIOR ART
Figure 11B:
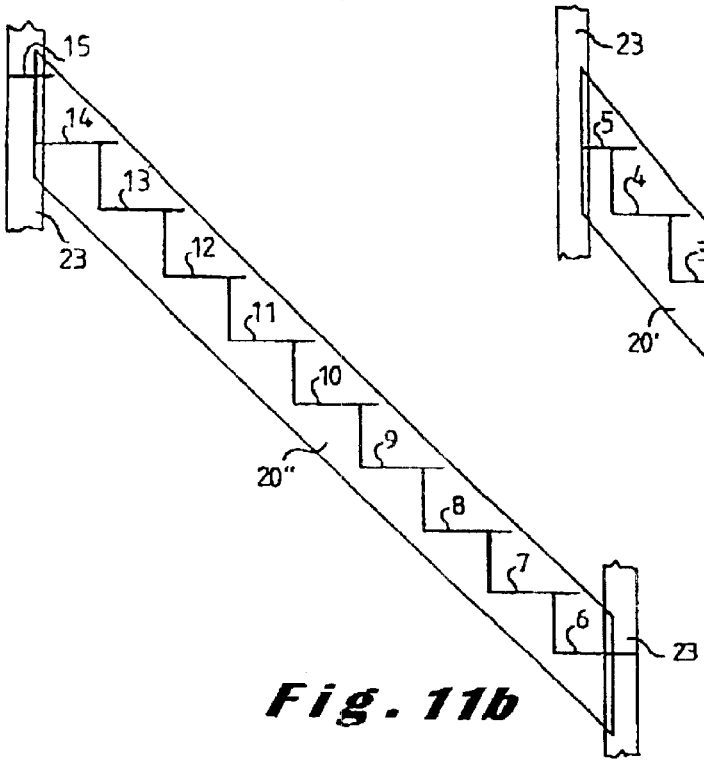
Figure 11A:
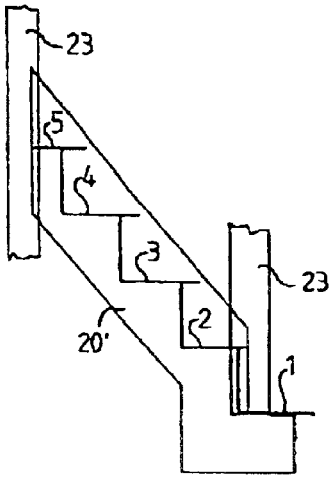

The outer strings 21' and 21" are however curved due to the balancing of the steps, more particular over their entire length since the stair is a completely balanced stair. As can be seen in FIGS. 10*a* and 10*b*, the method according to the prior art results in an irregular nosing line 31 (comprising a straight portion for steps 1–5, a kink after step 5 and before step 8, and again a straight portion for steps 8–15). Indeed, especially for steps 7 and 8, it can be seen that there is a greater distance between the front edges 26 and the top of the outer string 21 which has been drawn, in contrast to the nosing line 31, according to a flowing line. In practice, this is of course not a nicely finished stair. Consequently, one could try to remedy this defect by making steps 7 and 8 for example wider, but this would make steps 2 and 6 too narrow. The stair would therefore still be not easy to walk on.

Figure 12B:
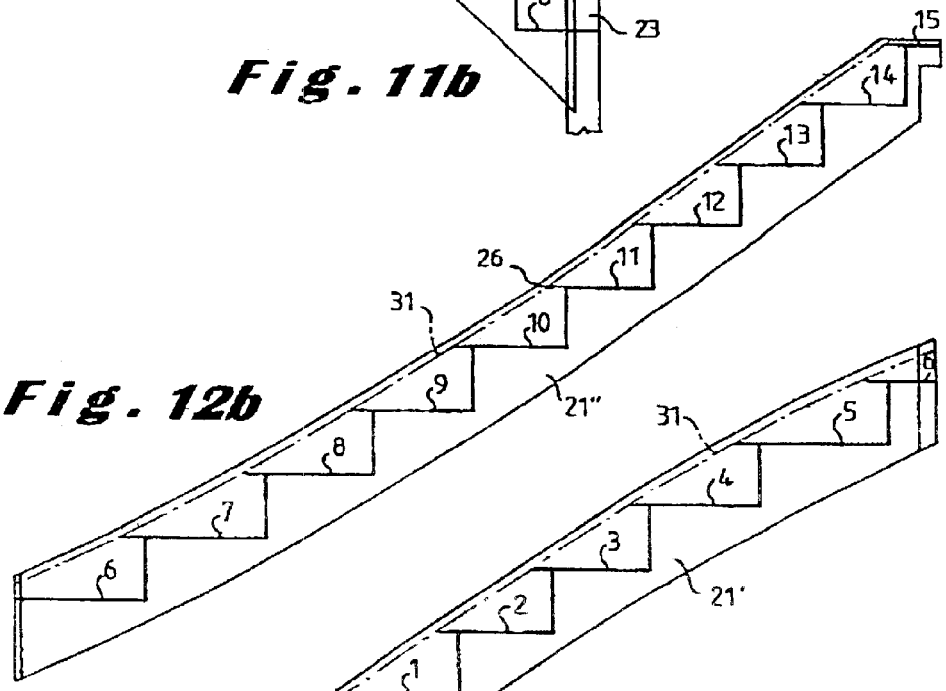
Figure 12A:
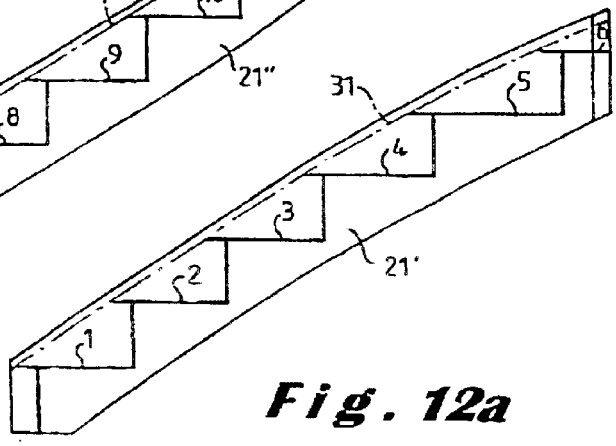

As can be seen in FIGS. 12*a* and 12*b*, the method according to the invention results in a smooth nosing line 31. The top of the outer string 21 can therefore be drawn at a constant distance from the nosings 26 so that a nicely finished stair is automatically obtained. This stair is moreover easier to walk on since all the steps have the same width. An essential difference with the prior art stair is that the steps at the lower and upper ends of the stair have a somewhat smaller width of tread so that at these ends, the outer strings 21' and 21" are somewhat steeper.

FIG. 13 shows a completely balanced prior art quarter turn stair having its turn at its lowermost end. FIG. 14 shows a same stair, designed in accordance with the method according to the invention (starting from the front edge of the uppermost step 15 and measuring distance d according to a measuring line 27 which is perpendicular (angle α=90°) to this front edge and which intersects the line of travel 22 with its middle point 28, for aesthetic reasons, the lowermost step has however been made somewhat broader or deeper). Again it can be seen that step 5 of the prior art stair is considerably narrower than the steps at both ends, in particular about 3 cm when the uppermost step has a width of about 19 cm.

The inner string is for both stairs the same straight string which has been illustrated in FIG. 15. The outer strings 21' and 21" of the prior art stair are shown in FIGS. 16*a* and 16*b*. It can be seen that for step 5, just after the turn, there is a considerably greater distance between its nosing 26 and the smooth top of the outer string 21" whilst for step 3 the nosing 26 extends nearly to the top of outer string 21'. This is of course not aesthetic. The irregular distance from the nosing line 31 to the top of the outer string 21 is due to the fact that the nosing line 31 is not a flowing line. In fact, from step 15 to step 6, the nosing line is nearly a straight line. This means that the transition from the concave top of the uppermost outer string 21" to the convex top of the lowermost outer string 21' has to be achieved over a very short distance. This results of course in abrupt bendings or in other words in a non-smooth line.

In the stair designed according to the method according to the invention, the nosing line at the outer strings 21' and 21" is a smooth line which starts already to curve from the uppermost steps 15, 14, 13, . . . In this way, there is obtained a smooth transition between the concave and convex tops of the strings 21" and 21', without any abrupt curving at the step 5 just after the turn.

FIG. 18 illustrates a prior art stair which differs from the stair illustrated in FIG. 13 in that the uppermost steps 10–15 are not balanced. Only steps 1–9 are balanced, more particularly according to the harmonic balancing method. Due to this harmonic balancing technique, the inner string, which is illustrated in FIG. 19, is curved, starting from step 9, according to a smooth line. However, notwithstanding this balancing technique, it appears that especially step 5 is not deep enough to walk easy on the stair. Moreover, the nosing line 31 at the outer string 21" consists from the top to the bottom successively of two straight portions, namely for steps 15 to 10 and for steps 9 to 6, after which there is a sudden curve over the nosings of steps 5 and 4. When the top of the outer string 20" has been made more smoothly as illustrated in FIG. 20*b*, this results in a too large distance between the nosing of step 5 and the top of the outer string 21". Just as for the stairs illustrated in FIGS. 13 and 14, this drawback can be obviated by applying the method according to the present invention but this has not been illustrated in the drawing.

From the above description of some particular embodiments of the method according to the invention, it will be clear that many modifications can be applied thereto without leaving the scope of the invention as defined by the appended claims.

It will especially be clear that the method for measuring the mutual distances d can be applied in combination with any existing balancing technique and to many different kinds of stair. It can for example not only be applied to balanced straight stairs or quarter-turn stairs but also to half-turn stairs. The stairs may further be so-called geometrical stairs which do not have a newel in their turns. In order to avoid sudden bends in the-inner strings or in the handrailing of such stairs in the turning, the steps before and/or after the turn should be strongly balanced. Especially in this case, the method according to the invention provides a large improvement over the known methods.

Of course, the stairs may be made of different materials and assembled in any known way without leaving the scope of the invention.

What is claimed is:

1. A method for constructing a balanced stair comprising steps with treads showing front edges, which method comprises the step of designing the stair and the step of materially constructing the stair so designed, the designing step comprising the step of determining a line of travel on the stair, the step of determining a reference line onto each step in a position with respect to the front edge thereof, and the step of dividing said reference lines along said line of travel so that the reference lines of each pair of two adjoining reference lines are situated on a substantially constant mutual distance near said line of travel, at least a number of said steps being balanced so that the front edges thereof define an angle different from a right angle with said line of travel, characterised in that in said dividing step, said substantially constant mutual distance is determined near said line of travel along a measuring line which is determined for each pair of adjoining reference lines so as to form a substantially constant angle with at least one of the adjoining reference lines thereof.

2. A method according to claim 1, characterised in that said reference lines are determined on said steps either parallel to or coinciding with the front edge of said steps.

3. A method according to claim 1, characterised in that said substantially constant angle is an angle of between 80 and 100°, preferably an angle of between 85 and 95° and most preferably an angle of about 90°.

4. A method according to any one of the claim 1, characterised in that the stair has two opposite ends, and in that, starting at least from the reference line on the step at a first one of said opposite ends, the adjacent reference line situated closer to a second one of said opposite ends is each time positioned on said substantially constant mutual distance measured near said line of travel along said measuring line to form each time one of said pairs of adjoining reference lines, which measuring line is determined for this latter pair of adjoining reference lines so as to form said substantially constant angle with the reference line which is the closest to said first end and/or with the reference line which is the closest to said second end.

5. A method according to claim 4, characterised in that said measuring line is determined so as to form said substantially constant angle with the reference line which is the closest to said first end and so as to form a further substantially constant angle with the reference line which is the closest to said second end.

6. A method according to claim 5, characterised in that said further substantially constant angle is an angle of between 80 and 100°, preferably an angle of between 85 and 95° and most preferably an angle of about 90°.

7. A method according to claim 6, characterised in that use is made each time of a circle, having a centre and a diameter equal to said substantially constant mutual distance, for positioning said adjacent reference line situated closer to said second opposite end, which circle is positioned with its centre substantially onto said line of travel so that the reference line situated near said first end is tangent to this circle and the adjoining reference line situated closer to said second end is positioned so as to be also tangent to the circle.

8. A method according to claim 4, characterised in that starting from the reference line on the step at said first opposite end, the adjacent reference line situated closer to said second opposite end is each time positioned on said substantially constant mutual distance until the reference line of the step at said second end of the stair is positioned and when this latter reference line is positioned in such a manner that the front edge of this step does not substantially coincide with the second end of the stair, positioning of the reference lines is started again either with a smaller substantially constant mutual distance and/or with a substantially constant angle which differs more from a right angle in case the front edge of the step at said second end extends beyond this end or with a greater substantially constant mutual distance and/or with a substantially constant angle which differs less from a right angle in case the front edge of the step at said second end does not extend up to this second end.

9. A method according to claim 4, characterised in that starting from the reference line on the step at said first opposite end, the adjacent reference line situated closer to said second opposite end is each time positioned on said substantially constant mutual distance and starting from the reference line on the step at said second opposite end, the adjacent reference line situated closer to said first opposite end is each time positioned on said substantially constant mutual distance until a predetermined reference line is positioned both starting from said first end and from said second end and when this predetermined reference line is positioned not in substantially the same position when starting from the first and the second end of the stair, positioning of the reference lines is started again either with a smaller substantially constant mutual distance and/or with a substantially constant angle which differs more from a right angle in case the predetermined reference line positioned starting from the first end of the stair extends beyond the predetermined reference line positioned starting from the second end of the stair or with a greater substantially constant mutual distance and/or with a substantially constant angle which differs less from a right angle in case the predetermined reference line positioned starting from the first end of the stair does not extend up to the predetermined reference line positioned starting from the second end of the stair.

10. A method according to claim 1, characterised in that said measuring line has a length equal to said substantially constant mutual distance and is positioned in such a manner with respect to the line of travel that a predetermined point on the measuring line is situated on said line of travel.

11. A method according to claim 10, characterised in that said predetermined point is situated substantially in the middle of said measuring line.

* * * * *